US006742421B1

(12) United States Patent
Chen

(10) Patent No.: US 6,742,421 B1
(45) Date of Patent: Jun. 1, 2004

(54) SCREWDRIVER

(76) Inventor: Jui-Tung Chen, No. 2, Ting-Chu-Wei, Huwei Chen, Yunlin Hsien (TW)

( * ) Notice: Subject to any disclaimer, the term of this patent is extended or adjusted under 35 U.S.C. 154(b) by 36 days.

(21) Appl. No.: 10/316,073

(22) Filed: Dec. 11, 2002

(51) Int. Cl.[7] ..... B25G 1/08

(52) U.S. Cl. ..... 81/490; 81/177.4; 81/437; 81/438; 81/439; 81/440

(58) Field of Search ..... 81/490, 177.4, 81/437, 438, 439, 440

(56) References Cited

U.S. PATENT DOCUMENTS 5,421,225 A * 6/1995 Chen ..... 81/490
5,918,513 A * 7/1999 Ho ..... 81/490
6,032,332 A * 3/2000 Lin ..... 16/111.1
6,352,010 B1 * 3/2002 Giarritta et al. ..... 81/177.4

* cited by examiner

*Primary Examiner*—Lee D. Wilson
*Assistant Examiner*—Alvin J. Grant
(74) *Attorney, Agent, or Firm*—Bacon & Thomas PLLC

(57) ABSTRACT

A screwdriver includes a hollow cylindrical body with multiple elongated holes defined in an outer periphery of the hollow cylindrical body to communicate with inside of the hollow cylindrical body. Bit compartments are provided to be pivotally connected to the hollow cylindrical body and each bit compartment is provided with a hole adapted for receiving therein a bit. A lid is integrally formed with the bit compartment to cover a corresponding elongated hole. A controlling disk is rotatably connected to a side face of the hollow cylindrical body to control pivotal movement of the bit compartments so that rotation of the controlling disk is able to pivot the bit compartments relative to the hollow cylindrical body to reveal the bits received in the holes of the bit compartments.

19 Claims, 6 Drawing Sheets

SCREWDRIVER

BACKGROUND OF THE INVENTION

1. Field of the Invention

The present invention relates to a screwdriver, and more particularly to a screwdriver having bits removably received inside the screwdriver so that the user is able to have access to the bits by rotating a controlling disk to pivot bit compartments which are pivotally connected to a hollow cylindrical body of the screwdriver.

2. Description of Related Art

A conventional screwdriver usually is composed of a handle and multiple bits detachably connected to the handle. When the bits are not needed, a compartment is provided to receive the bits so that the user is able to have easy access to the bits when required.

To overcome the shortcomings, the present invention tends to provide an improved screwdriver to mitigate and obviate the aforementioned problems.

SUMMARY OF THE INVENTION

The primary objective of the present invention is to provide an improved screwdriver having a hollow cylindrical body and multiple bit compartments pivotally connected to the body to respectively receive therein bits so that pivotal movement of the bit compartments is able to provide the user access to the bits.

Another objective of the present invention is to provide an improved screwdriver having a bit cartridge detachably received in the handle of the screwdriver such that pulling a bottom plate of the bit cartridge is able to detach the bit cartridge from the handle of the screwdriver and thus provide the user access to the bits.

Other objects, advantages and novel features of the invention will become more apparent from the following detailed description when taken in conjunction with the accompanying drawings.

DETAILED DESCRIPTION OF THE PREFERRED EMBODIMENT

Figure 1:
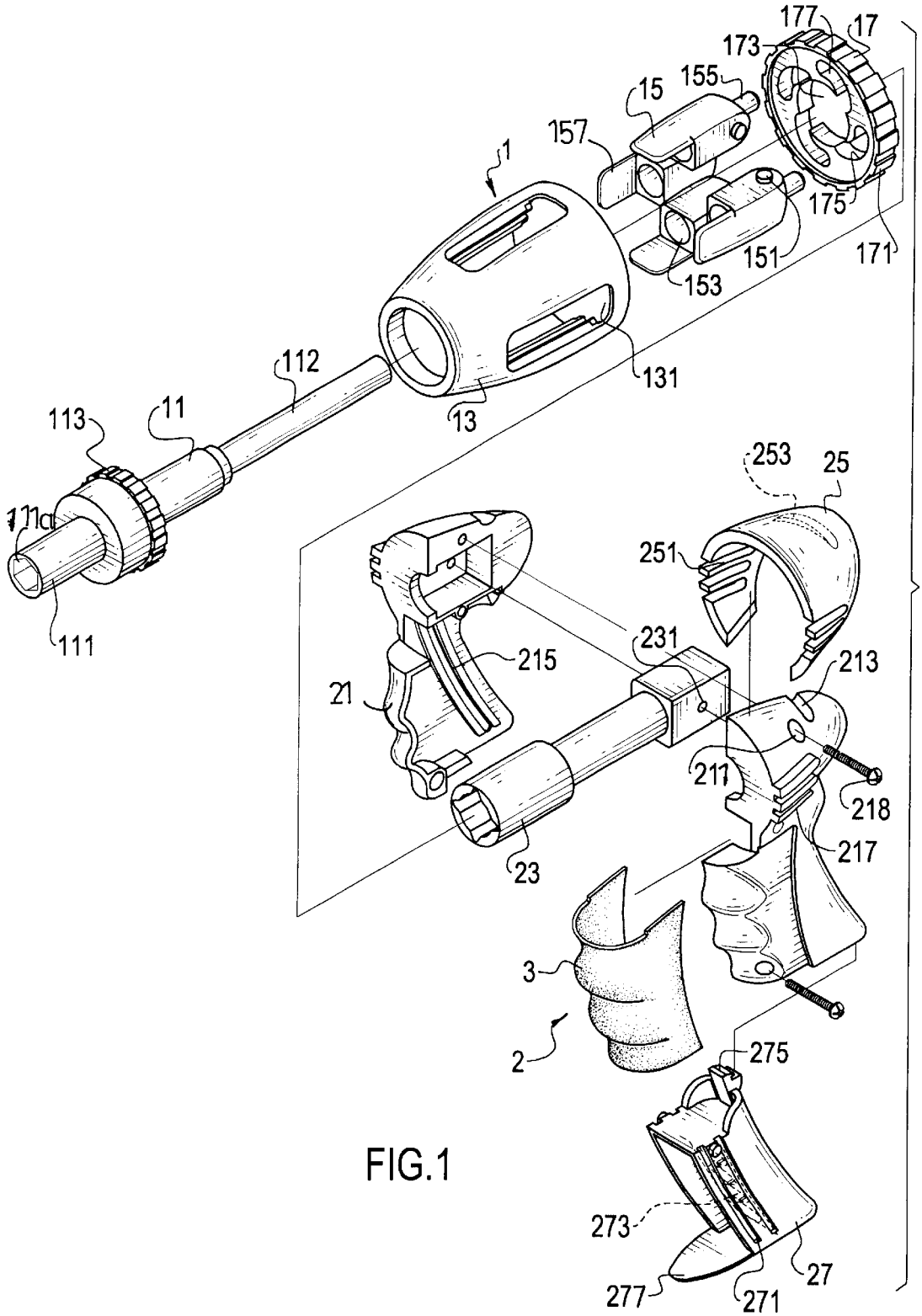
FIG. 1 is an exploded perspective view of the screwdriver of the present invention.

With reference to FIG. 1, the screwdriver in accordance with the present invention has a main body (1) and a handle (2) securely connected to the main body (1).

The main body (1) includes an operation rod (11), a hollow cylindrical body (13), multiple bit compartments (15) and a controlling disk (17).

The operation rod (11) has a first section (111) with an open end (11 la) defined in a distal end of the operation rod (11) to receive therein a bit (not shown), a second section (112) connected to the first section (111) and an orientation control disk (113) provided at a joint between the first and the second sections (111,112) to allow, the first section (111) to selectively and alternately rotate clockwise and counterclockwise. Because the mechanism of the orientation control disk (113) is conventional in the art, detailed description thereof is omitted hereinafter.

The hollow cylindrical body (13) defines two open ends respectively in two ends of the hollow cylindrical body (13) and multiple elongated holes (131) circumferentially defined in an outer surface of the hollow cylindrical body (13).

Each of the bit compartments (15) has a pair of bosses (151) respectively extending from opposite sides of the bit compartment (15), a hole (153) defined in the bit compartment (15), a positioning rod (155) integrally formed on a rear side of the bit compartment (15) and lid (157) extending from a side of the hole (153).

The controlling disk (17) has a pattern (171) formed on an outer periphery of the controlling disk (17) to facilitate rotation of the controlling disk (17), a central hole (173) defined to correspond to the operation rod (11) and arcuate holes (175) defined in the controlling disk (17) and respectively in communication with the central hole (173). Each arcuate hole (175) has a projection (177) formed on an inner face defining the arcuate hole (175).

The handle (2) has a holding portion (21), an assembly rod (23), a rear cap (25) and a bit cartridge (27).

The holding portion (21) is composed of two mutually complementary halves each having a recess (213), a guiding track (215) and multiple ribs (217) extending from a side face of each of the halves.

The assembly rod (23) has an open end defined to securely receive a distal end of the second section (112) of the operation rod (11) and a through hole (231) defined to correspond to an assembly hole (211) defined in each of the two halves of the holding portion (21).

The rear cap (25) has multiple slits (251) defined in two opposite sides of the rear cap (25) to correspond to the ribs (217) of each of the two halves of the holding portion (21) and a stop (253) formed on an inner face of the rear cap (25) to correspond to the recess (213) of each of the two halves of the holding portion (21).

Figure 4:
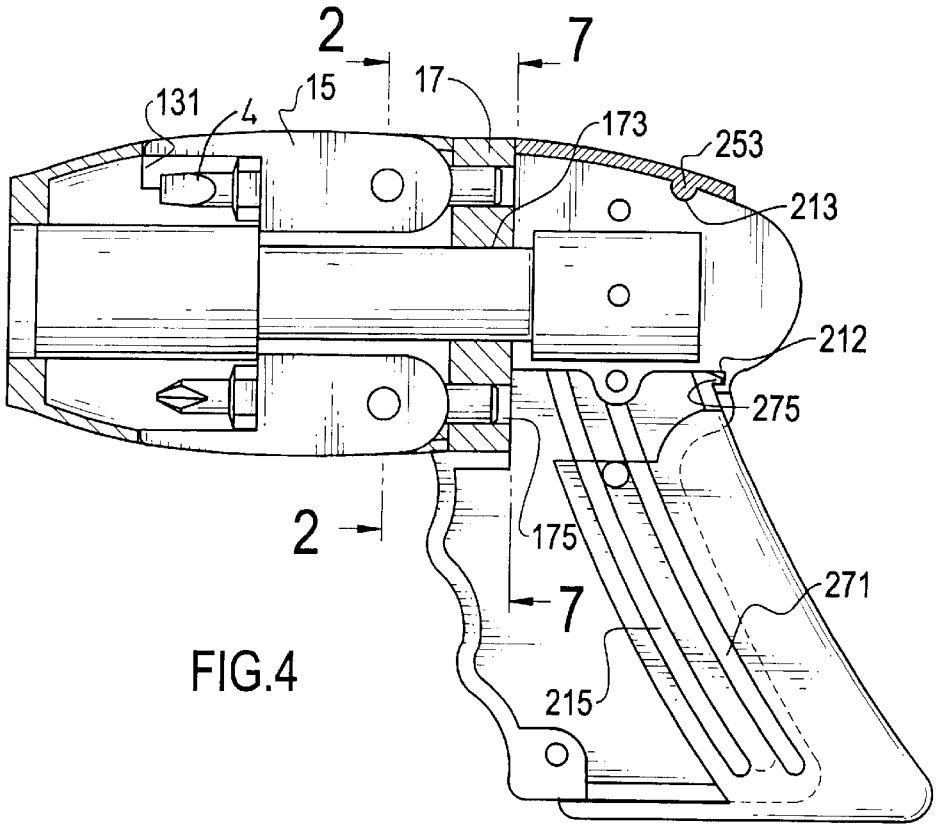
FIG. 4 is a schematic view showing that the bit compartments are received inside the body.

The bit cartridge (27) has two guiding ribs (271) respectively formed on two opposite sides of the bit cartridge (27) to respectively correspond to each of the guiding tracks (215) of the two halves of the holding portion (21), spaces (273) defined in the bit cartridge (27), a hook (275) formed on a top end of the bit cartridge (27) to correspond to a step (212) (as shown in FIG. 4) inside the two halves of the holding portion (21) and a bottom plate (277) formed on a bottom end of the bit cartridge (27).

Figure 2:
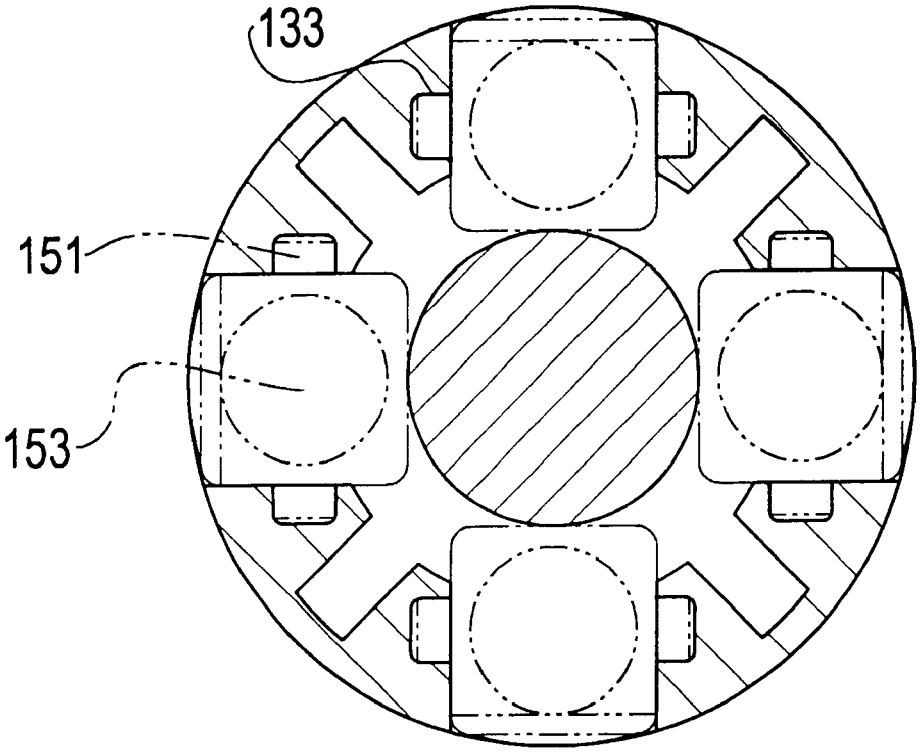
FIG. 2 is a cross sectional view by taking the line 2—2 in FIG. 4 showing the relationship between the hollow cylindrical body and the bit compartments.

With reference to FIG. 2 and still taking FIG. 1 for reference, when the screwdriver of the present invention is in assembly, the bosses (151) of each of the bit compartments (15) are respectively received in a pair of pivot holes (133) in the body (13) and the positioning rods (155) extend out of the body (13). Meantime, the lid (157) covers the corresponding elongated hole (13). The operation rod (11) extends through the body (13), the bit compartments (15)

and the central hole (173) of the controlling disk (17), wherein the operation rod (11) abuts an outer periphery defining one open end of the hollow cylindrical body (13) with the orientation control disk (113). After the bit compartments (15) are pivotally connected to the hollow cylindrical body (13), the controlling disk (17) is provided to allow each of the positioning rods (155) to be received in a corresponding one of the arcuate holes (175). Thereafter, the two halves of the holding portion (21) are engaged with each other to receive therein a portion of the assembly rod (23) with the assembly hole (211) aligned with the through hole (231) such that a first bolt (218) is able to secure the relative position between the assembly rod (23) and the holding portion (21). The rear cap (25) is then provided to have the stop (253) received in the recess (213) and the ribs (217) received in the slits (251). A second bolt (219) is provided to secure the two halves of the holding portion (21). Because of the first and second bolts (218,219), the engagement between the two halves of the holding portion (21) is secured and because there is nothing to secure the controlling disk (17), the controlling disk (17) is able to pivot relative to the hollow cylindrical body (13) and the holding portion (21). Then the bit cartridge (27) is inserted into the holding portion (21) with the guiding ribs (271) received in the guiding track (215) and the hook (275) engaged with the step (212), as shown in FIG. 4. Lastly, a cover (3) is attached to a side face of the holding portion (21) to maintain smooth appearance of the holding portion.

Figure 7:
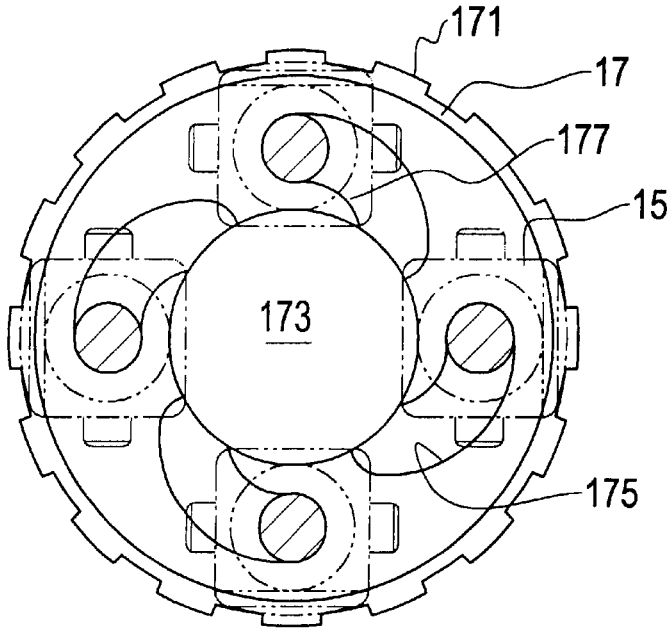
FIG. 7 is a cross sectional view by taking the line 7—7 in FIG. 4.

With reference to FIGS. 4 and 7 and still taking FIG. 1 for reference, after the assembly, each of the positioning rods (155) is received in one end of the corresponding arcuate hole (175) and a bit (4) is received in each one of the hole (153).

Figure 3:
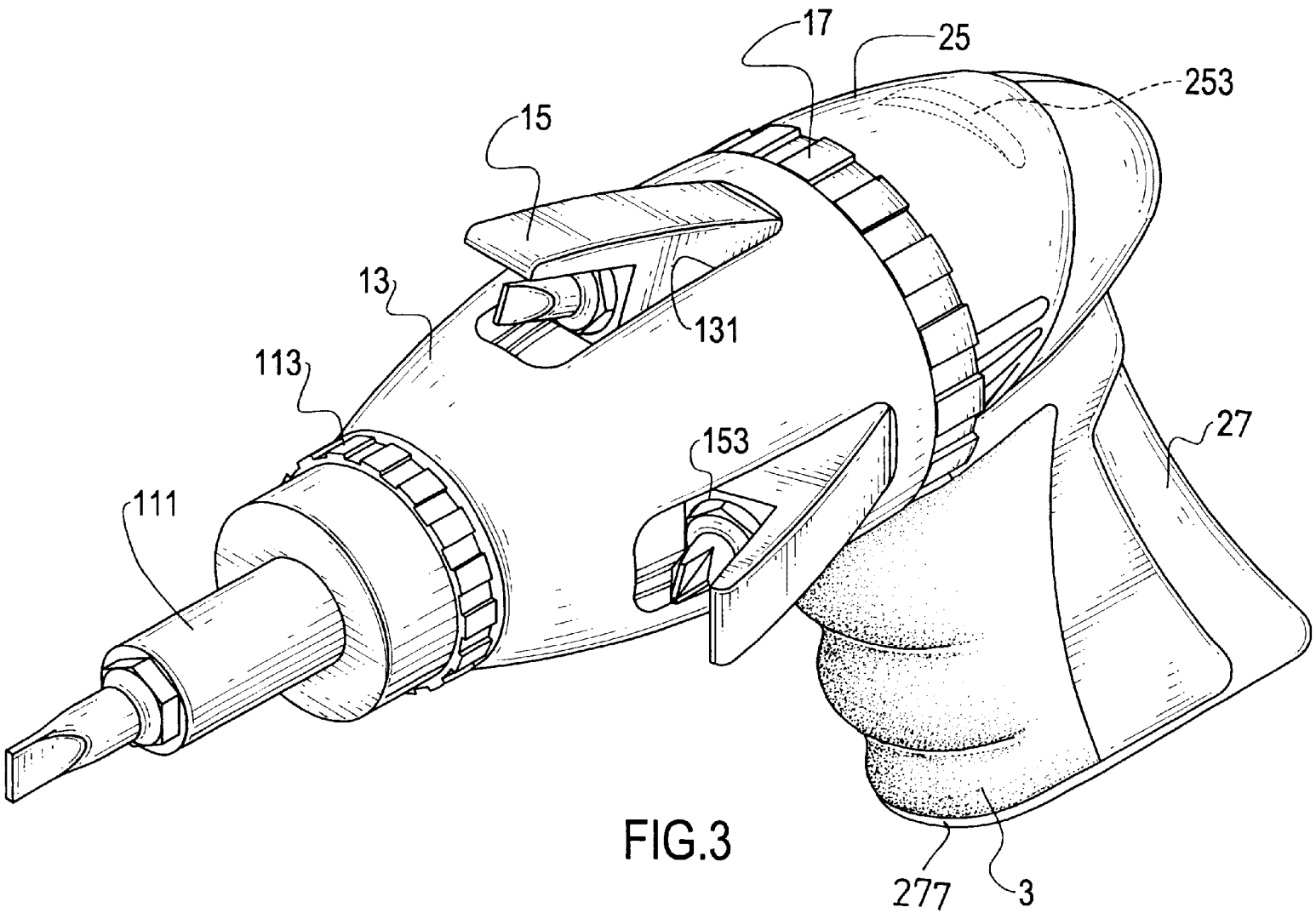
FIG. 3 is a perspective view showing the screwdriver in assembly.
Figure 5:
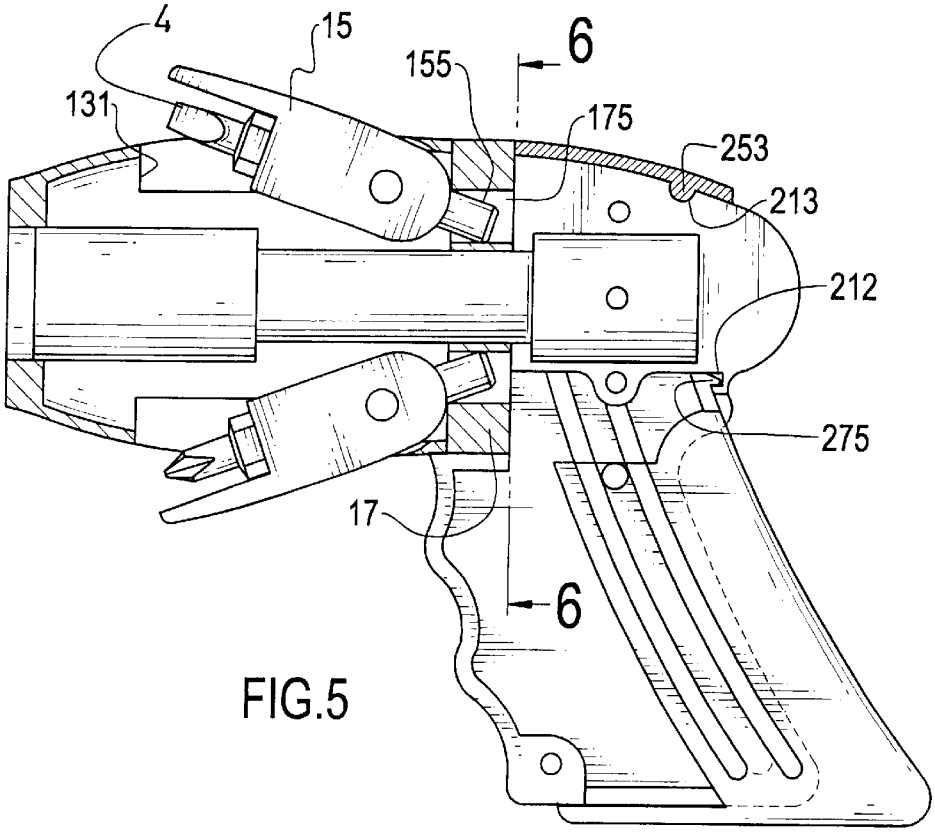
FIG. 5 is a schematic view showing the bit compartments are pivoted so as to allow the user to have access to the bits received in the bit compartments.
Figure 6:
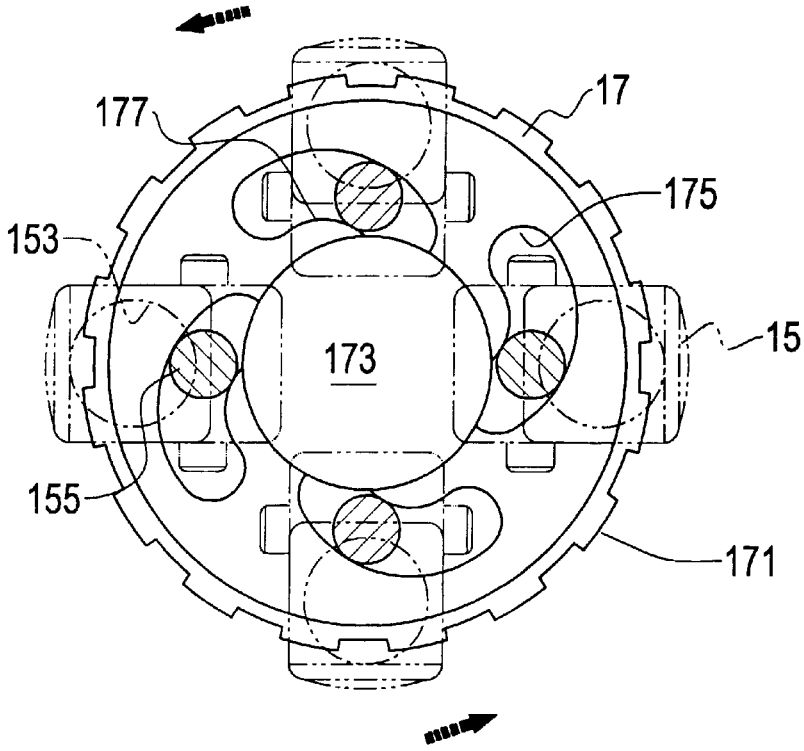
FIG. 6 is a cross sectional view by taking the line 6—6 in FIG. 5.

With reference to FIGS. 3, 5 and 6 and still taking FIG. 2 for reference, when the controlling disk (17) is pivoted in a direction as indicated by arrow in FIG. 6, the positioning rods (155) slide in the arcuate holes (175). When the positioning rods (155) slide over the projections (177), each of the bit compartments (15) is pivoted so that each of the bits (4) received in the hollow cylindrical body (13) is revealed for selection. On the contrary, when the controlling disk (17) is pivoted in an opposite direction, each of the lids (157) covers the corresponding elongated hole (131) again.

Figure 8:
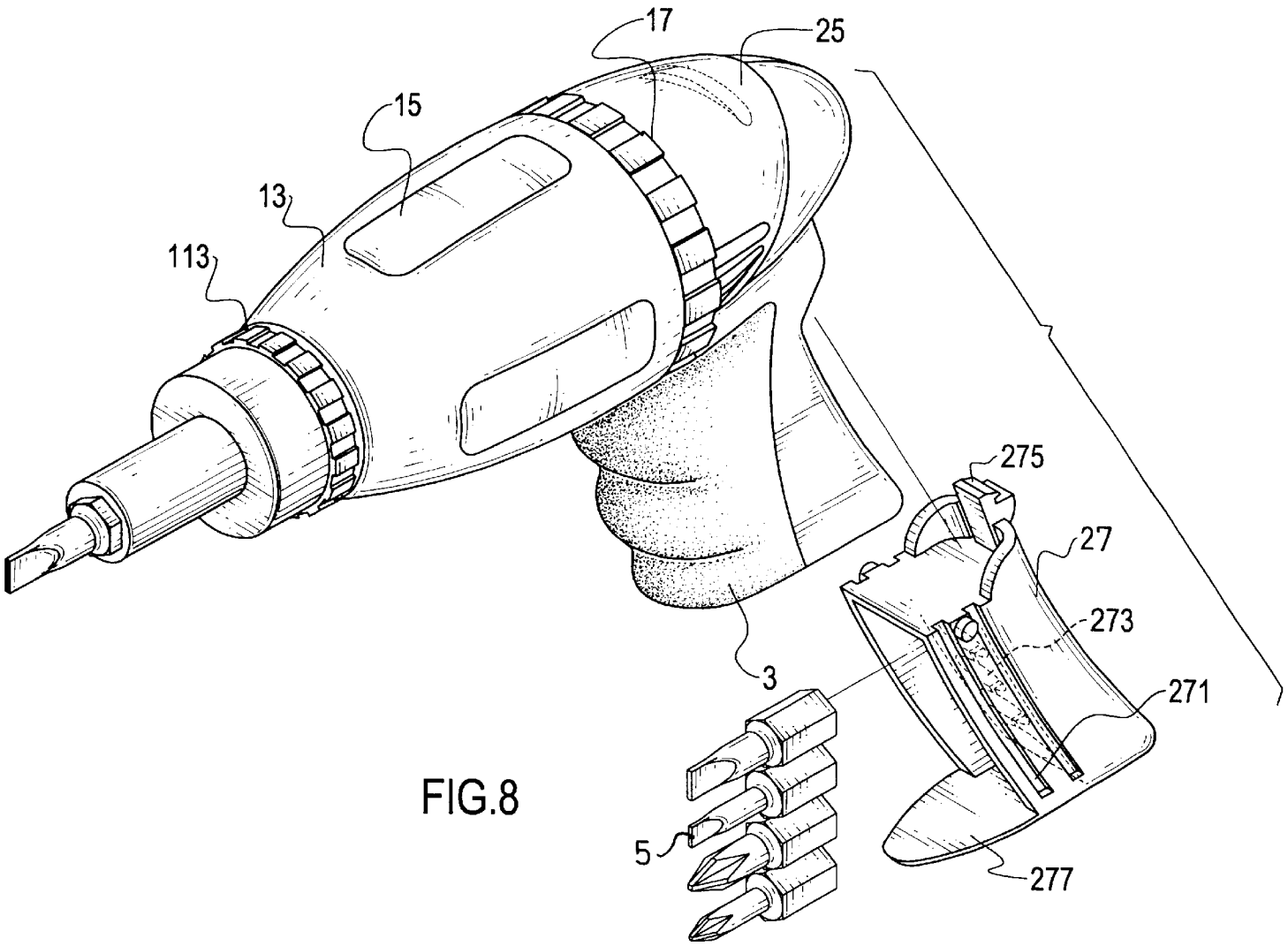
FIG. 8 is an exploded perspective view showing the bit cartridge detached from the handle of the screwdriver.

With reference to FIGS. 3, 4 and 8, it is to be noted that when it is required that bits 5 be received in space 273 are required, the user may pull the bottom plate (277) to disengage the connection between the hook (275) and the step (212). Thus, the user is able to have access to the bits (5) in the bit cartridge (27).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A screwdriver comprising:

a hollow cylindrical body with multiple elongated holes defined in an outer periphery of the hollow cylindrical body to communicate with an interior of the hollow cylindrical body;

bit compartments pivotally connected to the hollow cylindrical body and each bit compartment provided with a hole adapted for receiving therein a bit and a lid integrally formed with the bit compartment to cover a corresponding elongated hole; and a controlling disk rotatably connected to a side face of the hollow cylindrical body to control pivotal movement of the bit compartments so that rotation of the controlling disk is able to pivot the bit compartments relative to the hollow cylindrical body to reveal the bits received in the holes of the bit compartments.

2. The screwdriver as claimed in claim 1, wherein the hollow cylindrical body has multiple pairs of pivot holes defined inside the hollow cylindrical body to correspond to two bosses respectively formed on opposite sides of each of the bit compartments such that after the bosses are received in the corresponding pivot holes, the bit compartments are able to pivot relative to the hollow cylindrical body.

3. The screwdriver as claimed in claim 2, wherein each bit compartment has a positioning rod extending out of the bit compartment.

4. The screwdriver as claimed in claim 3, wherein the controlling disk has arcuate holes each corresponding to one of the positioning rods so that the positioning rods are received in the arcuate holes.

5. The screwdriver as claimed in claim 1 further comprising an operation rod received in the hollow cylindrical body and having an orientation control disk formed on the orientation control disk to abut an outer periphery of the hollow cylindrical body, the operation rod has an open end adapted to detachably receive therein a selected one of the bits.

6. The screwdriver as claimed in claim 4 further comprising an operation rod received in the hollow cylindrical body and having an orientation control disk formed on the orientation to abut an outer periphery of the hollow cylindrical body, the operation rod has an open end adapted to detachably receive therein a selected one of the bits.

7. The screwdriver as claimed in claim 1 further comprising a handle securely connected to the hollow cylindrical body and having a holding portion abutted to a side face of the controlling disk and an assembly rod securely received in the holding portion to connect to a distal end of the operation rod.

8. The screwdriver as claimed in claim 6 further comprising a handle securely connected to the hollow cylindrical body and having a holding portion abutted to a side face of the controlling disk and an assembly rod securely received in the holding portion to connect to a distal end of the operation rod.

9. The screwdriver as claimed in claim 8 further comprising a bit cartridge detachably received in the holding portion and having spaces adapted for respectively receiving the bits therein.

10. The screwdriver as claimed in claim 9, wherein the holding portion has guiding tracks formed inside the holding portion and the bit cartridge has guiding ribs formed on an outer face of the bit cartridge to correspond to the guiding tracks such that the bit cartridge is able to slide inside the holding portion.

11. The screwdriver as claimed in claim 10, wherein the holding portion has a step and the bit cartridge has a hook corresponding to the step so that the bit cartridge is able to be tachably connected to the holding portion.

12. The screwdriver as claimed in claim 9 further comprising a rear cap having therein a stop formed to corresponding to a recess defined in a top face of the holding portion and slits defined in opposite side faces of the rear cap to correspond to ribs formed on opposite side faces of the holding portion.

13. The screwdriver as claimed in claim 11 further comprising a rear cap having therein a stop formed to correspond to a recess defined in a top face of the holding portion and slits defined in opposite side faces of the rear cap to correspond to ribs formed on opposite side faces of the holding portion.

14. The screwdriver as claimed in claim 4, wherein each of the arcuate holes has a projection formed inside the arcuate hole so that when the positioning rod passes over the projection, the bit compartments are pivoted.

15. The screwdriver as claimed in claim 6, wherein each of the arcuate holes has a projection formed inside the arcuate hole so that when the positioning rod passes over the projection, the bit compartment is pivoted.

16. The screwdriver as claimed in claim 8, wherein each of the arcuate holes has a projection formed inside the arcuate hole so that when the positioning rod passes over the projection, the bit compartment is pivoted.

17. The screwdriver as claimed in claim 10, wherein each of the arcuate holes has a projection formed inside the arcuate hole so that when the positioning rod passes over the projection, the bit compartment is pivoted.

18. The screwdriver as claimed in claim 11, wherein each of the arcuate holes has a projection formed inside the arcuate hole so that when the positioning rod passes over the projection, the bit compartment is pivoted.

19. The screwdriver as claimed in claim 13, wherein each of the arcuate holes has a projection formed inside the arcuate hole so that when the positioning rod passes over the projection, the bit compartment is pivoted.

* * * * *